United States Patent [19]

Stahlecker et al.

[11] 4,435,952

[45] Mar. 13, 1984

[54] SPINNING ASSEMBLY FOR A WRAPPED YARN SPINNING MACHINE

[75] Inventors: Fritz Stahlecker, Josef-Neidhart-Str. 18, 7347 Bad Überkingen, Fed. Rep. of Germany; Kurt Lang, Lauterstein; Rolf Erhardt, Wäschenbeuren, both of Fed. Rep. of Germany

[73] Assignees: Fritz Stahlecker; Hans Stahlecker, both of Fed. Rep. of Germany

[21] Appl. No.: 332,760

[22] Filed: Dec. 21, 1981

[30] Foreign Application Priority Data

Jan. 16, 1981 [DE] Fed. Rep. of Germany ..... 3101146

[51] Int. Cl.[3] ..... D02G 3/36; D01H 7/18; D01H 11/00

[52] U.S. Cl. ..... 57/18; 57/304

[58] Field of Search ..... 57/16–18, 57/304, 305

[56] References Cited

U.S. PATENT DOCUMENTS 4,170,101 10/1979 Bock ..... 57/18 X
4,226,077 10/1980 Hilbert ..... 57/18
4,299,083 11/1981 Igel et al. ..... 57/18
4,336,683 6/1982 Bock et al. ..... 57/18

*Primary Examiner*—John Petrakes
*Attorney, Agent, or Firm*—Craig & Burns

[57] ABSTRACT

A spinning assembly for a wrapped yarn spinning machine in which a staple sliver is guided by a delivery device into a hollow spindle which carries a co-rotating binding thread; the thread is wound around the staple sliver by the rotation of the hollow spindle. A stationary balloon limiter is provided in the vicinity of the binding thread and a screen is mounted in front of the delivery device, which screen comprises a passage for the staple sliver. This screen is constructed as a screen plate, mounted at an axial distance from the balloon limiter. This construction of the present invention has the advantage that an air stream is generated within the balloon limiter, which flows upward from below and leaves radially through the gap between the upper end of the uncovered balloon limiter and the screen plate. This air stream is directed counter to both the sliver and the binding thread entering the hollow spindle, so that no fiber fly can penetrate the interior of the hollow spindle.

20 Claims, 8 Drawing Figures

SPINNING ASSEMBLY FOR A WRAPPED YARN SPINNING MACHINE

BACKGROUND AND SUMMARY OF THE INVENTION

The invention relates to a spinning assembly for a wrapped yarn spinning machine with a hollow spindle, said spindle carrying a co-rotating binding thread wrapping, covering material and being disposed between a delivery device for a staple sliver to be covered and a removal apparatus for the wrapped yarn. The spindle is further surrounded in the vicinity of the binding thread with a stationary balloon limiter, with which limiter a likewise stationary screen for the binding thread is associated, said screen being located between the delivery device and the balloon limiter, said screen comprising a passage for the staple sliver.

A spinning assembly of this type is known from German Offenlegungsschrift No. 29 28 890. The balloon limiter surrounding the hollow spindle is covered by a lid, in which only one feed opening is provided for the sliver, and therefore completely encapsulates the hollow spindle and binding thread from the ambient atmosphere. This is intended to ensure that the binding thread does not pick up any fiber fly or the like, floating in the air, as the balloon if formed, while it is being wrapped around the sliver. Such inclusions of fiber fly not only have a detrimental effect upon the appearance of the finished-wrapped yarn, but can occasionally even lead to accumulations of material and hence to thread breaks. In the known device, the lower end of the hollow spindle is connected to a pneumatic source, which generates an air stream in the direction of the covered or wrapped yarn, in such a way that the accumulation of fiber fly or the like within the hollow spindle is to be avoided.

It has been found that the desired goals or objects can be achieved only very imperfectly with the known device. In particular, the pneumatic source connected to the hollow spindle continually draws air through the feed opening of the balloon limiter lid. This air which is drawn in, necessarily brings fiber fly with it, which, once inside the balloon limiter, is bound to penetrate the interior of the hollow spindle and therefore is often incorporated into the resultant wrapped yarn. Fiber fly which enters through the feed opening of the balloon limiter lid is practically impossible to eliminate from the vicinity of the resultant yarn.

In a device according to German Offenlegungsschrift No. 29 13 762, therefore, in order to avoid the disadvantages outlined above, the binding thread is subjected to an air stream prior to its entry into the hollow spindle, and a mechanical means of stripping fiber fly off the filament thread is also provided. For this purpose, the lid of the balloon limiter is not mounted in a stationary fashion on the balloon limiter itself, but rather the lid is designed as a rotating disk, mounted on the spindle head. This disk leaves an annular slit free between itself and the wall of the balloon limiter, through which special structural designs permit air to flow from above into the interior of the balloon limiter, whereupon the air is guided out of the balloon limiter again further down. The disk is made convex on its upper surface in such a way that the binding thread, brought out through the abovementioned annular slit from the balloon limiter, can abut this convex surface of the rotating disk, thereby preventing accumulations of fiber tufts.

In this device, the increased energy consumption is disadvantageous, because the co-rotating disk results in an increase in inertia. In addition, the cost of manufacturing such a device is relatively high.

An object of the present invention is to avoid the disadvantages of the abovementioned devices and to provide a wrapped yarn spinning machine wherein fiber-fly accumulations in the binding thread can be avoided without increasing the energy demand. This goal is achieved in preferred embodiments of the present invention by providing a screen constructed as a screen plate and located at an axial distance from the balloon limiter.

The features of the invention ensure that an air stream is generated within the balloon limiter without using suction devices of any kind, the stream flowing upward from below and being deflected radially outward through the gap between the upper end of the uncovered balloon limiter and the screen plate, and escaping thereat. Thus, a situation is created in which the air stream is directed opposite to the movement of the sliver travelling into the hollow spindle as well as the binding thread travelling into the hollow spindle, so that there is no way in which fiber fly can penetrate the interior of the hollow spindle. The rotating hollow spindle generates the abovementioned air stream itself in the device according to preferred embodiments of the invention.

Further advantageous embodiments and features of the invention are set forth in the claims and the description. Thus, it is advantageous for the screen plate to comprise a threading slit. When beginning spinning with the spinning assembly, for example, after a thread break, it is conventional to feed an auxiliary thread through the hollow spindle in a direction opposite to the subsequent production direction. This auxiliary thread must be connected with the binding thread and the sliver, and must therefore be guided through the passage located in the screen for the staple sliver. To facilitate the operating task, a radial slit is provided, extending outward from the passage, through which slit the auxiliary thread can simply be inserted from outside in through the passage. The threading slit has dimensions such that the sliver, guided through the passage in the screen plate, cannot inadvertently enter this slit during normal spinning.

With the structural dimensions for the balloon limiter and hollow spindle which were used on the application date, it is advantageous for the interval between the balloon limiter and the screen to be approximately 15 to 25 mm. With these dimensions, optimum flow conditions result.

In another embodiment of the invention, a preferably adjustable suction device is associated with the screen plate. The suction device is advantageously located on the side away from the balloon limiter. This means that the air stream emerging frm the balloon limiter, deflected radially outward by the screen, will not be adversely affected by the suction. In addition, this is intended to draw off the fly which enters on the sliver itself through the passage in the screen. In order to prevent product fibers from being unnecessarily drawn off, this suction is preferably made adjustable in such a way that it can assume different positions relative to the sliver during operation and during the start of spinning. Provision is made for the air stream not to have a directly disadvantageous effect on the sliver during operation, so that product fibers will not be drawn off unnecessarily, but only the upper edge of the screen plate, essentially, will be kept clean. During the start of spinning, therefore, the suction can be brought closer to the passage in the screen so that the sliver can be held in the correct position for starting spinning when spinning begins.

It is advantageous in certain preferred embodiments for a tube surrounding the sliver to be associated with the screen plate, the tube extending from the screen plate to the delivery device and/or the hollow spindle. In this way, the path of the sliver before it enters the hollow spindle is largely enclosed whereby a slit required for threading can be provided if desired. This enclosure ensures that individual fibers cannot separate from the sliver.

As far as the invention's design is concerned, it is advantageous in especially the preferred embodiments for a common screen plate to be associated with a plurality of balloon limiters. The screen plate is therefore designed, so to speak, as a lattice extending over a plurality of spinning units, resulting in considerable simplification of manufacture.

These and other objects, features, and advantages of the present invention will become more apparent from the following description when taken in conjunction with the accompanying drawings which show, for the purposes of illustration only, several embodiments in accordance with the present invention, and wherein:

DETAILED DESCRIPTION OF THE DRAWINGS

Figure 1:
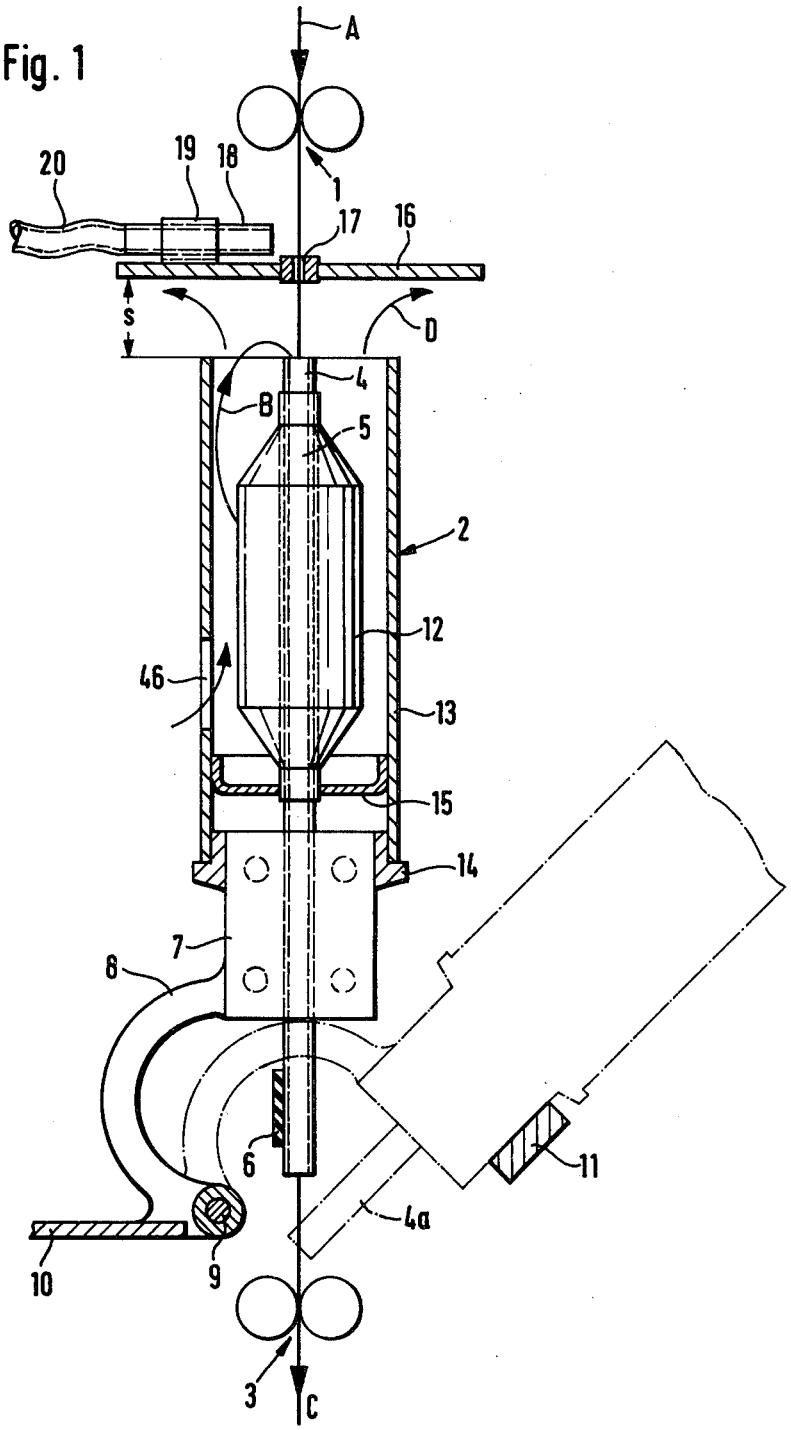
FIG. 1 is a schematic sectional view through a spinning assembly of a yarn spinning machine with a device constructed according to a preferred embodiment of the invention.

In the drawings and description, only those details of the spinning machines are specifically disclosed as are necessary to a full understanding of the present invention, so as not to obscure the same. Those skilled in the art of wrapped yarn spinning machines given the present disclosure and the state of this art, should readily be able to practice the invention described and claimed.

The yarn spinning assembly in FIG. 1 comprises essentially a delivery device 1, a twister 2, as well as a withdrawing apparatus 3. Twister 2 comprises a spindle 4 with a lengthwise bore 5. Spindle 4 is rotatably mounted in a bearing housing 7 and driven by a tangential belt 6, which extends over a plurality of spinning units. Bearing housing 7 is mounted on a bracket 8 which is pivotal about a stationary shaft 9 from an operating position into an off position, shown by the dot-dashed line (see position 4*a* of the spindle) up to a stop 11. A retaining plate 10, shown only partially, is fastened to bracket 8; the actuating elements (not shown) to pivot spindle 4 engage the plate.

Delivery device 1 feeds a sliver A to hollow spindle 4, the sliver being guided through lengthwise bore 5 of spindle 4. Spindle 4 is equipped with a co-rotating feed bobbin 12 for a binding thread B, the thread being unwound from feed bobbin 12 during spinning and likewise being fed into lengthwise bore 5 of hollow spindle 4. Binding thread B is wound around sliver A during the spinning process, thereby producing wrapped yarn C, which is fed from withdrawing apparatus 3 to a winder, not shown.

Hollow spindle 4 and feed bobbin 12 for binding thread B are surrounded by a balloon limiter 13 designed as a cylindrical sleeve, the limiter being firmly connected with bearing housing 7 and comprising an aperture 46 in its lateral wall, in its lower area, for the air inlet. Balloon limiter 13 is mounted in bearing housing 7 by means of a holder 14, and is closed below by a button 15 which is provided with a passage for hollow spindle 4 and/or the lower end of feed bobbin 12.

A screen plate 16 is disposed at an axial distance (s) from the open end of balloon limiter 13, whereby a thread guide 17 with a passage for the sliver A to be covered or wrapped is provided in screen plate 16. Screen plate 16 is mounted preferably 15 to 25 mm above the upper edge of balloon limiter 13, when hollow spindle 4 and balloon limiter 13 have ordinary dimensions, and ensures that, when the selected dimensions are maintained, an air stream is generated which enters the balloon limiter 13 through aperture 46, as a result of the rotation of hollow spindle 4 and feed bobbin 12 mounted thereon, and is deflected radially outward at the top, out of balloon limiter 13 in the direction indicated by arrow D. This air stream, which acts upon hollow spindle 4 in a direction opposite to the feed direction of sliver A, ensures that binding thread B and sliver A remain free of fiber fly when they enter longitudinal bore 5 of hollow spindle 4. A suction tube 18 is mounted on plate 16 by a holder 19 on the side of screen plate 16 which is opposite balloon limiter 13. Suction tube 18 is connected by a flexible line 20 to a vacuum source, not shown. In this manner, (1) the upper side of screen 16 can be freed of dust while (2) fiber fly entrained by sliver A is removed before sliver A passes through thread guide 17.

Figure 2:
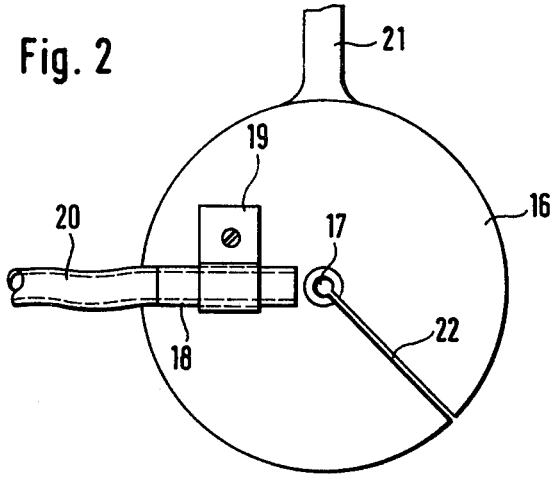
FIG. 2 is a top schematic view of the spinning assembly shown in FIG. 1, with several parts omitted.

FIG. 2 shows the screen plate 16 in FIG. 1 from above, with most of the parts of the rewinding yarn spinning assembly omitted. In the middle of the screen plate 16, thread guide 17, provided with a through-bore, is visible, whereby a threading slit 22 runs outward radially from this through-bore, through which an auxiliary thread is guided from outside into the through-bore, especially when starting spinning. Screen plate 16 is secured by a holder 21 on the machine frame, in a manner not shown in greater detail. In addition, holder 19, as shown, is fastened by a screw connection to screen plate 16 and carries the suction tube 18, to which is connected a flexible line 20, connected to the vacuum source, not shown.

Figure 3:
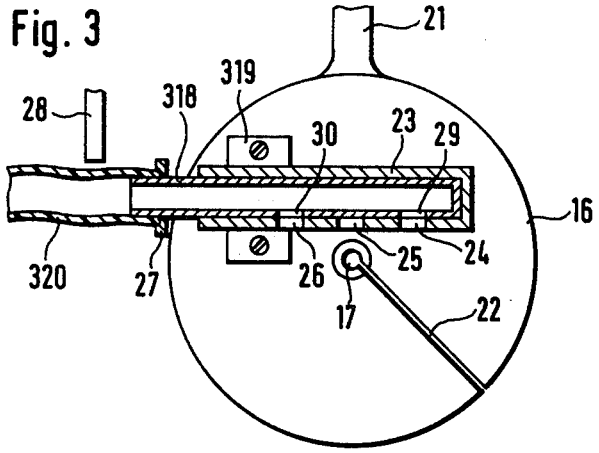
FIG. 3 is a view similar to FIG. 2, but showing an embodiment with an adjustable suction device shown in spinning operation position.
Figure 4:
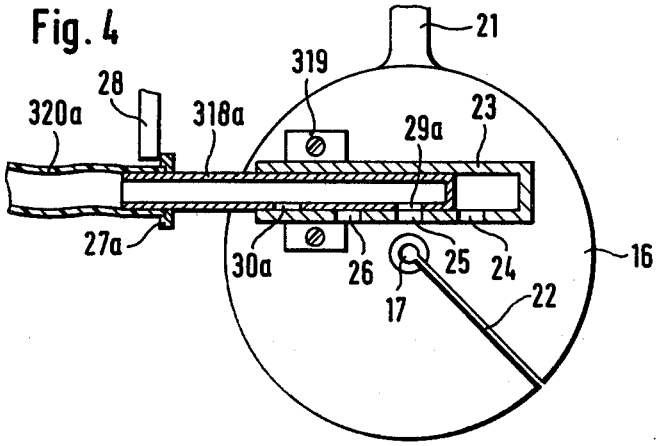
FIG. 4 shows the embodiment of FIG. 3, but during the start of spinning.

FIGS. 3 and 4 show the same screen plate 16, with which, however, another suction device is associated, shown in FIG. 3 in the operating condition and in FIG. 4 in the off or inoperative condition.

Suction tube 318, in the embodiment shown in FIG. 3, is guided in a cylindrical sleeve 23 which, in turn, is secured on screen plate 16 by a mounting device 319. Suction tube 318 is connected to a flexible line 320, leading to a vacuum source. Cylindrical sleeve 23 is provided on its outer surface with three successive bores 24, 25 and 26, extending in the axial direction which are directed essentially toward the sliver A, guided through the passage in thread guide 17. Suction tube 318 comprises corresponding bores 29 and 30, but only two of them. In the operating condition (FIG. 3), bores 29 and 30 of suction tube 318 are located exactly opposite bores 24 and 26 of cylindrical holder 23 which are located furthest away axially, thereby ensuring that suction tube 318, whose end is closed, is guided up to the end of sleeve 23 which serves as a stop. Therefore, during spinning, air is drawn into the interior of suction tube 318 both through bores 24 and 29, and through bores 26 and 30. Bore 25 of sleeve 23, on the other hand, is sealed during spinning. This means that the air which enters suction tube 318 is drawn in at a certain distance from sliver A so that no product fibers are drawn off sliver A, but only the fiber fly surrounding sliver A is drawn off.

In the inoperative condition, especially when starting spinning, suction tube 318 is displaced into position 318*a* (see FIG. 4), until annular bead 27*a* located on suction tube 318 abuts at a stop 28. Bores 29 and 30 shift to positions 29*a* and 30*a*, respectively, in the inoperative condition, whereby only bore 29*a* communicates with the outside air, specifically with bore 25 of sleeve 23. No air can enter the interior of suction tube 318*a* through bores 24 and 26 in sleeve 23. This means that the flow of suction air in the inoperative condition comes very close to sliver A and can, as desired, temporarily hold on to sliver A during the start of spinning.

Figure 5:
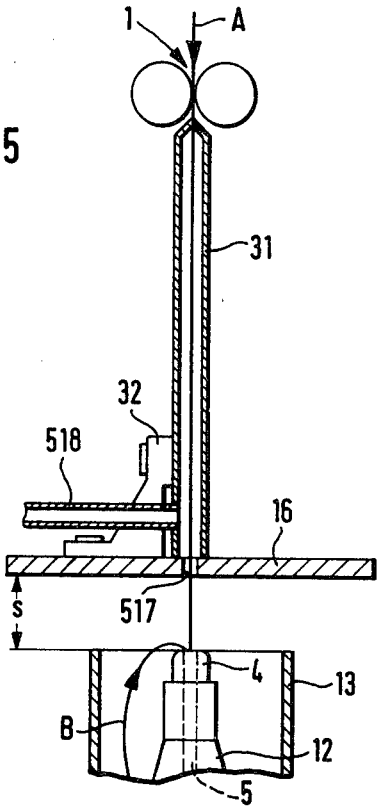
FIG. 5 is a partial schematic axial sectional view through a portion of a spinning assembly of a wrapped yarn spinning machine, showing another preferred embodiment of the invention.

FIG. 5 shows the upper part of an embodiment similar to FIG. 1. The embodiment shown in FIG. 5 differs from the embodiment shown in FIG. 1 primarily in that a tube 31, enclosing sliver A, is provided on the side of screen plate 16 which faces away from balloon limiter 13, whereby the tube 31, like screen plate 16, comprises a threading slit, not shown in FIG. 5. Tube 31 is secured to screen plate 16 by a mounting device 32 which carries a suction tube 518 terminating in tube 31. Tube 31 ensures that no fiber material from sliver A is removed in the form of product fibers between delivery device 1 and screen 16, with special attention being directed to ensure that suction 518 operates only during the start of spinning. Sliver A is not wrapped between the balloon limiter 13 and the screen plate 16 because it is at this point that air stream D, described by reference to FIG. 1, emerges from balloon limiter 13 and is deflected radially outward, whereby fly accumulations in binding thread B are avoided. The embodiment shown in FIG. 5 makes it possible to locate delivery device 1 above screen plate 16 by an amount which is greater than the average staple length.

Figure 6:
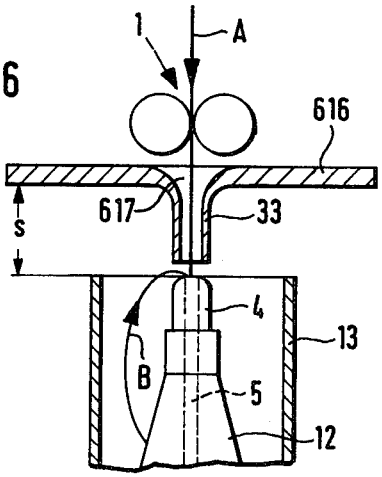
FIG. 6 is a view similar to FIG. 5, but showing a further preferred embodiment of the invention.

In the embodiment shown in FIG. 6, delivery device 1 is located closer to the stationary balloon limiter 13. Here, screen plate 616 is located in the immediate vicinity of delivery device 1, whereby, however, distance (s) to the upper edge of balloon limiter 13 is approximately the same as in the previous embodiments. In the embodiment shown in FIG. 6, tube 33 for enclosing sliver A is located in the area between screen plate 616 and the upper edge of balloon limiter 13. Tube stub 33 can serve, if desired, as a guide for binding thread B, entering the hollow spindle 4. Here, opening 617 in screen plate 616 is made funnel-shaped. Likewise, in the embodiment according to FIG. 6, the air stream emerges upward from balloon limiter 13 and is deflected radially outward.

Figure 7:
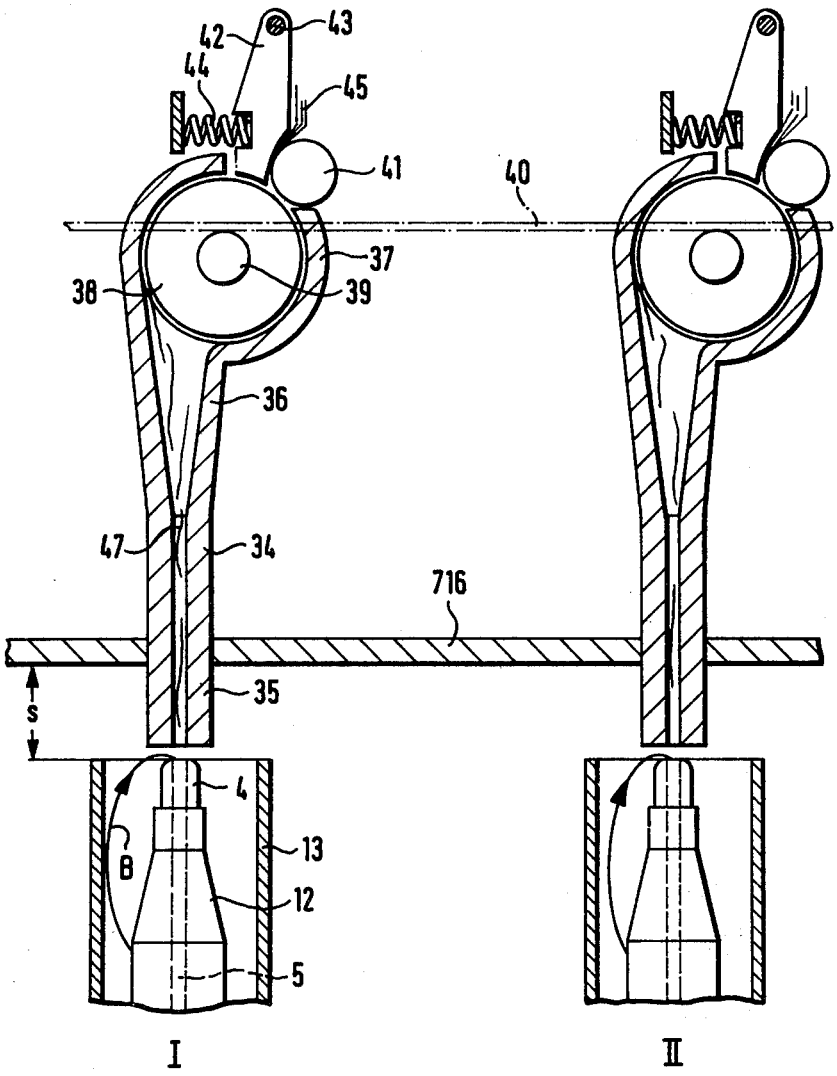
FIG. 7 is a schematic axial sectional view through a pair of spinning assemblies of a wrapped yarn spinning machine showing a preferred embodiment with a screen extending over a plurality of spinning units.

In the embodiment shown in FIG. 7, a plurality of wrapped yarn spinning assemblies, of which only two spinning assemblies I and II are shown, are equipped with a common screen plate 716. This screen plate 716 can be associated in the above-described manner with the individual delivery devices 1, possibly designed as a draw frame. FIG. 7, however, illustrates a construction in which opening rollers 38 are provided instead of draw frame delivery devices. Opening rollers 38 of this kind, like those generally known from open-end spinning, make it possible to draw the fed sliver 45 much further and to open it up if desired into individual fibers 47. Sliver 45 is fed by way of a delivery device which consists of a feed roller 41 and a pressure table 42, to the opening roller 38 which revolves rapidly and is provided on its outer surface with fittings. Opening roller 38 is disposed in a housing 37 and provided with a whirl 39, which, in the present example, is driven by a tangential belt 40, indicated by the dot-dashed lines, which extends over a plurality of spinning units. Feed table 42 is swivelable about an shaft 43 and pressable against feed roller 41 by the pressure of a spring 44. Sliver 45, as already mentioned, is opened into individual fibers 47, which are then fed to hollow spindle 4 and then wrapped thereat by binding thread 3. The individual fibers 47 are surrounded by a tube in the vicinity of screen plate 716, the tube being designated by reference numeral 35 below the screen plate 716 and by reference numeral 34 above the screen 716. A tapering channel 36 is interposed between opening roller 38 and cylindrical tube 34.

The embodiment in FIG. 7 also provides for screen 716 at a distance (s) from the upper edge of the balloon limiter 13, whereby the screen again serves to free binding thread B of fiber fly.

Figure 8:
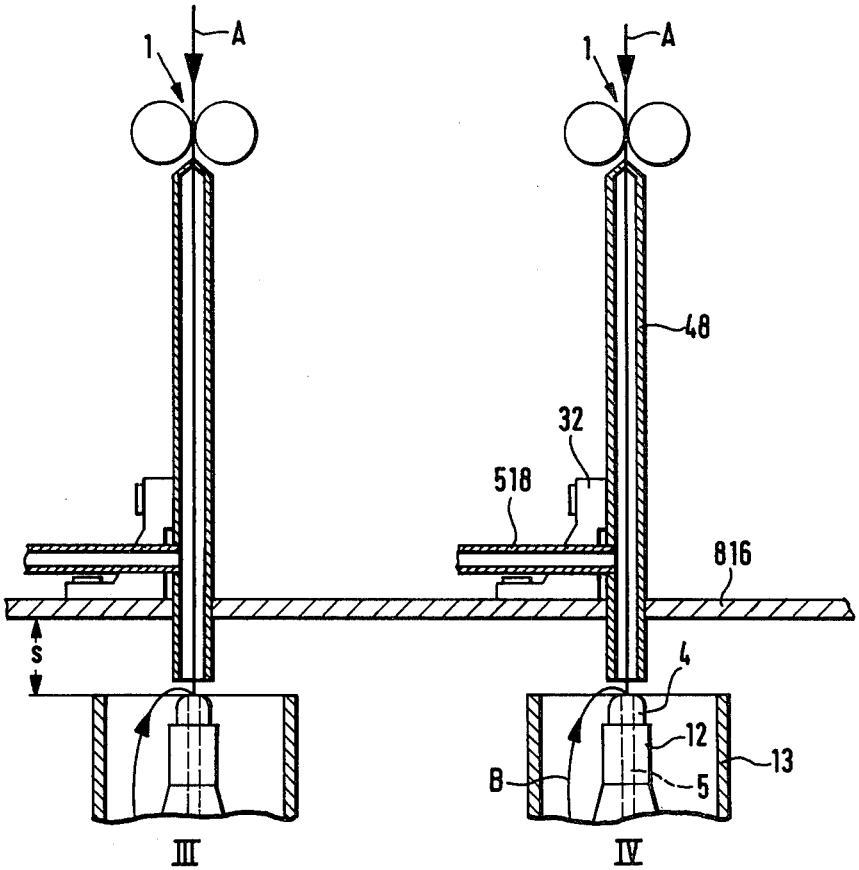
FIG. 8 is a view similar to FIG. 7, showing yet another embodiment with a screen extending over a plurality of spinning units.

FIG. 8 shows an embodiment wherein a screen 816 extends over a plurality of spinning units, of which two spinning units III and IV are shown. In these spinning units III and IV, a delivery device 1 for sliver A is again provided at a distance from the inlet to hollow spindle 4, this distance being greater than the average staple length of sliver A. Sliver A is enclosed by a small tube 48 over the entire distance between the delivery device 1 and the inlet of hollow spindle 4, the tube comprising a threading slit, not shown. The enclosure prevents individual fibers from leaving the sliver. A suction tube 518 is provided above screen 816 for each small tube 48, the tube 518 being secured to screen 816 by a mounting device 32. Provision may be made for suction tube 518 to operate only during the start of spinning. As in the foregoing embodiments, screen 816 is again mounted at a distance (s) above balloon limiter 13. This ensures that the air emerging upward from balloon limiter 13 is deflected radially outward, thus keeping the binding thread B free of fiber fly.

While we have shown and described several embodiments in accordance with the prsent invention, it is understood that the same is not limited thereto but is susceptible of numerous changes and modifications as known to one having ordinary skill in the art, and we therefore do not wish to be limited to the details shown and decribed herein, but intended to cover all such modifications as are encompassed by the scope of the appended claims.

I claim:

1. A spinning assembly for a wrapped yarn spinning machine comprising a hollow spindle carrying a co-rotating binding thread and disposed between delivery means for a sliver to be wrapped and a take-off means for the wrapped yarn, said binding thread moving toward the sliver to be wrapped thereby during rotation of said spindle, said spindle being surrounded in the vicinity of the binding thread with a stationary balloon limiter means, a relatively stationary screen plate means located between the delivery means and the balloon limiter means, said screen plate means being provided with a passage for sliver and being disposed at an axial distance from the balloon limiter means so that an airflow is able to take place in the balloon limiter means which airflow leaves the balloon limiter means in a generally radially outward direction and thus generally opposite the direction of movement of the binding thread to thereby prevent fly accumulation on the binding thread.

2. A spinning assembly according to claim 1, wherein the balloon limiter means includes a sleeve, open at the top, the open end of said sleeve being located opposite the screen plate means.

3. A spinning assembly according to claim 1, wherein an air inlet opening is provided in one side wall of the balloon limiter means.

4. A spinning assembly according to claim 1, wherein the screen plate means comprises a threading slit, said slit extending radially to the passage for the sliver.

5. A spinning assembly according to any one of claims 2, 3 or 4, wherein a suction device is associated with the screen plate means on the side facing away from the balloon limiter means.

6. A spinning assembly according to claim 1, wherein the distance between the top of the balloon limiter means and the screen plate means is between about 15 and 25 mm.

7. A spinning assembly according to claim 1, wherein a suction device is associated with the screen plate on the side facing away from the balloon limiter means.

8. A spinning assembly according to claim 7, wherein the suction device is designed as a suction tube adjustable relative to the passage for the sliver.

9. A spinning assembly according to claim 8, wherein the suction tube is a tube closed at one end and provided with lateral openings, said tube being guided lengthwise-displaceably in a cylindrical guide, likewise closed at one end, said guide being provided with inlet openings, said inlet openings being movable into a position for alignment with the openings in the suction tube by displacement of the suction tube.

10. A spinning assembly according to claim 9, wherein a tube enclosing the sliver is associated with the screen plate means said tube extending from the screen plate means to one of the delivery means and the hollow spindle.

11. A spinning assembly according to any one of claims 2, 3, 4 or 7, whrein the distance between the balloon limiter means and the screen plate means is between about 15 and 25 mm.

12. A spinning assembly according to any one of claims 2, 3, 6 or 7, wherein the screen plate means is formed as a common screen plate associated with a plurality of balloon limiter means at different spinning units.

13. A spinning assembly according to claim 1, wherein a tube enclosing the sliver is associated with the screen plate means, said tube extending from the screen plate means to one of the delivery means and the hollow spindle.

14. A spinning assembly according to claim 13, wherein the tube includes vacuum connection means for connection to a vacuum source.

15. A spinning assembly according to claim 1, wherein the screen plate means is formed as a common screen plate associated with a plurality of balloon limiters means at different spinning units.

16. A spinning assembly according to claim 1, wherein the delivery device includes an opening roll which opens the fibers and generally aligns the same in the direction of movement, and wherein a tube is provided for transporting the fibers to the spindle, said tube having an end portion extending through said screen plate and being relatively small cross section to bring the aligned fibers together into a sliver-like formation to be wrapped by said binding thread.

17. In a spinning assembly for a wrapped yarn spinning machine having a hollow spindle means carrying binding thread means rotating in unison with the spindle means and disposed between delivery means for a staple sliver to be wrapped with binding thread and take-off means for the wrapped yarn, said binding thread moving from said binding thread means in the direction toward said staple sliver as it unwinds from said binding thread means to wrap around said sliver, said spindle being surrounded in the vicinity of the binding thread means by a stationary balloon limiter means, the improvement comprising a relatively stationary screen plate means located between the delivery means and the balloon limiter means, said screen plate means being provided with a passage for staple sliver and being disposed at an axial distance from the balloon limiter means, and further means enabling an airflow within the balloon limiter means, which airflow at the top of the balloon limiter means is in a direction generally opposite the direction of movement of the binding thread to prevent fly accumulation on the binding thread as it moves toward the spindle means.

18. A spinning assembly for a wrapped yarn spinning machine, comprising a hollow spindle which carries a co-rotating binding thread and is disposed between delivery means for a staple sliver to be wrapped and take-off means for the wrapped yarn, said binding thread moving from said binding thread means in the direction toward said staple sliver as it unwinds from said binding thread means to wrap around said sliver, said spindle being surrounded in the vicinity of the binding thread by a stationary balloon limiter means, and a relatively stationary screen plate means located between the delivery means the the balloon limiter means, said screen plate means being provided with a passage for the staple sliver and being disposed at an axial distance from the balloon limiter means to enable an airflow in the balloon limiter means which airflow leaves the area of the balloon limiter means in a direction generally opposite the direction of movement of the binding thread toward the spindle to prevent fly accumulation on the binding thread.

19. A spinning assembly with a spindle having an inlet according to claim 1, in which the spindle inlet is located below the screen plate means.

20. A spinning assembly with a spindle having an inlet according to claim 19, in which the spindle inlet is spaced from the screen plate means at a distance of the order of the axial distance.

* * * * *